US006381425B2

(12) United States Patent
Sasai

(10) Patent No.: US 6,381,425 B2
(45) Date of Patent: Apr. 30, 2002

(54) IMAGE FORMING APPARATUS AND IMAGE FORMING METHOD EMPLOYING THE SAME

(75) Inventor: Takahiro Sasai, Kyoto (JP)

(73) Assignee: Murata Kikai Kabushiki Kaisha, Kyoto (JP)

( * ) Notice: Subject to any disclaimer, the term of this patent is extended or adjusted under 35 U.S.C. 154(b) by 0 days.

(21) Appl. No.: 09/768,701

(22) Filed: Jan. 24, 2001

(30) Foreign Application Priority Data

Jan. 26, 2000 (JP) ..... 2000-016479

(51) Int. Cl.[7] ..... G03G 15/16; G03G 15/00
(52) U.S. Cl. ..... 399/66; 399/44
(58) Field of Search ..... 399/44, 66, 150, 399/297, 310, 313, 314

(56) References Cited

U.S. PATENT DOCUMENTS 5,606,400 A * 2/1997 Nagayasu et al. ..... 399/150 X
5,903,798 A * 5/1999 Yokogawa et al. ..... 399/66
5,909,605 A * 6/1999 Nishizawa et al. ..... 399/66
5,926,669 A * 7/1999 Sugimoto et al. ..... 399/66
6,026,257 A * 2/2000 Takami et al. ..... 399/66
6,047,144 A * 4/2000 Sasai et al. ..... 399/44

FOREIGN PATENT DOCUMENTS

JP 11-223968 8/1999
JP 11-305565 11/1999

* cited by examiner

*Primary Examiner*—Sandra Brase
(74) *Attorney, Agent, or Firm*—Hogan & Hartson

(57) ABSTRACT

In an image forming machine (1), a toner image formed on a photosensitive drum (22) is transferred to a recording sheet by applying a voltage (transfer voltage) to a transfer roller (26). The value of the voltage to be applied is determined by performing a feed back sequence based on information obtained after a predetermined number of recording sheets have been recorded. The point when a current detected in connection with the applied voltage has reached a predetermined value ($\alpha$) is considered the saturation of the applied voltage. Once this point is reached, there will be no feed back sequences to be performed. After the application voltage saturation, therefore, it is possible to continue the printing operation without any interruption since no feed back sequence is performed. This shortens a job duration.

20 Claims, 4 Drawing Sheets

IMAGE FORMING APPARATUS AND IMAGE FORMING METHOD EMPLOYING THE SAME

CROSS REFERENCES TO RELATED APPLICATION

This application claims priority under 35 USC 119 of Japanese Patent Application No. 2000–16479 filed on Jan. 26, 2000, the entire disclosure of which is incorporated herein by reference.

BACKGROUND OF THE INVENTION

1. Field of the Invention

The present invention relates to an apparatus for applying a voltage to a transfer roller for the purpose of transferring a toner image formed on a photosensitive body of an image forming apparatus onto a recording sheet, and especially to an apparatus equipped with a control means that applies a test voltage to the transfer roller and programs (decides and adjusts) the transfer bias. The present invention also relates to an image forming method employing said apparatus.

2. Description of the Related Art

In a conventional electrophotographic image forming apparatus, a toner image is transferred to a recording sheet as follows: an electrostatic latent image is formed on a photosensitive body (drum) by means of an exposing unit, and visualized with a toner supplied from a developer unit. The visualized image is a toner image, which is then transferred to the recording sheet. Finally the recording sheet bearing the toner image is fixed through a fixing unit to be a copy. A discharging member such as a corotron or a contact-transfer member such as a transfer roller may be used in order to transfer the image from the photosensitive body. One of the advantages of using a contact-transfer member such as a transfer roller over the corotron is that there is no ozone generated since unlike the corotron no corona discharge occurs. This results in elimination of such means as an ozone disposal unit in the exhaust system of an image forming apparatus.

The voltage application to said transfer roller as the transfer bias is greatly influenced by the temperature within the apparatus and also in the area surrounding it. At a low temperature, a voltage of a relatively large value should be applied (not larger than 3.5 kV), and the voltage decreases as the temperature within the apparatus increases and is set within the range between 0.5 and 2 kV. To control the transfer voltage, for example, a test voltage is applied to set the bias during the initializing procedure of the image forming apparatus. Later, after a predetermined number of sheets are recorded, a feed back sequence (hereinafter FB sequence) to apply a test voltage again is performed to change the setting of the transfer bias voltage.

However, in a typical image forming apparatus, in many cases a set of documents are placed to make a large set of copies in succession unless the machine allows only one document at a time and requires replacement of the document each time. In addition, many image forming apparatus have a function to set the number of copies at the maximum of 99. Successive printing within that limit is available. In this type of successive printing of large number of sheets, the temperature inside the apparatus rises because of the heat conducted from the fixing unit and the like even when performing a single job.

While a set of jobs are performed, there is a tendency that each time said FB sequence is performed, the values of detected currents keep increasing. So, the voltage applied to the transfer roller becomes gradually smaller. Therefore, even though a test voltage is applied, and the voltage to be applied is decided based on the detected current in the FB sequence, the value of such voltage to be applied tends to be the same due to the saturation. If the decided value after FB sequence always remains the same as the one used before the FB sequence, there is no use performing FB sequences. In addition, if FB sequences are repeatedly conducted during the series of jobs, the time needed for the completion of the series of jobs tends to be longer by the duration of the FB sequences.

SUMMARY OF THE INVENTION

It is thus an object of the present invention to solve the problems stated above concerning the FB sequence against the transfer roller.

According to one aspect of the present invention, there is provided an image forming apparatus provided with a transfer roller and performing a sequence during jobs in order to decide a value of the transfer bias by applying a test voltage, characterized in that whenever the saturation is reached by the voltage to be applied, which is decided based on the detected currents obtained when the test voltage is applied, said FB sequence will no longer be performed at least during the job. When the detected current at the time of the application of the test voltage exceeds a certain level, it may be considered that the saturation has been reached. The transfer bias may be determined based on the detected current when the test voltage is applied, and also on the temperature at that moment.

With the image forming apparatus of the present invention, the time required until completion of the job is shortened because wasteful sequences are omitted after it is decided that the saturation has been reached by the transfer voltage that is determined based on the current detected upon application of the test voltage in the FB sequence. Furthermore, by deciding and/or adjusting said transfer bias based on the conditions including both the detected current and temperature in said FB sequence, it is possible to more accurately decide and adjust the transfer bias in view of the environment. Moreover, users have to wait less because the time required for the printing in large number is reduced. Further, the decreased time of operation for each component member of the image forming apparatus means the increased life of the processing units.

BRIEF DESCRIPTION OF THE ACCOMPANYING DRAWINGS

DETAILED DESCRIPTION OF THE INVENTION

While the present invention will be described in connection with a preferred embodiment thereof, it will be understood that it is not intended to limit the invention to that embodiment.

Figure 1:
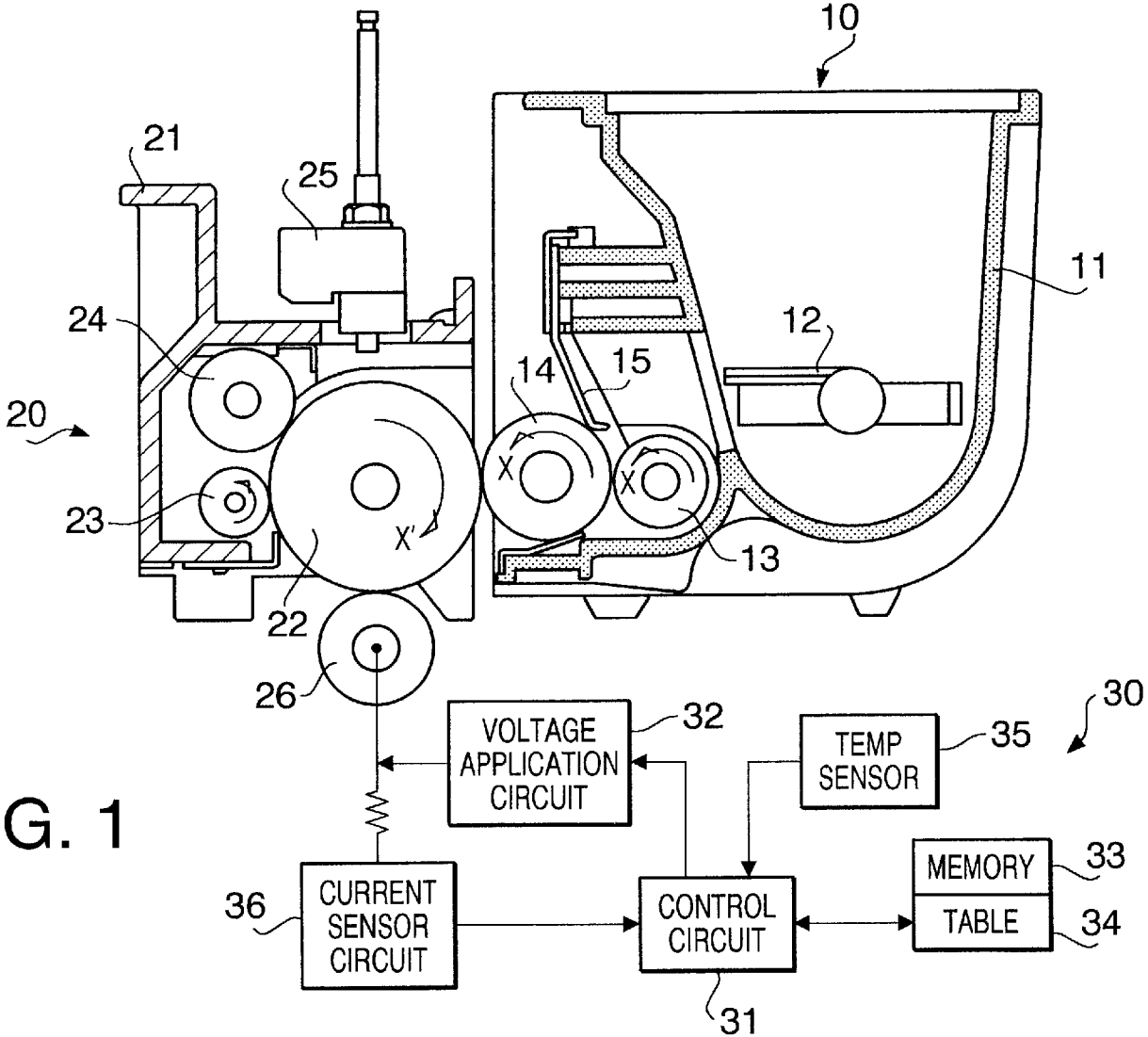
FIG. 1 is a schematic diagram showing the structure of a photosensitive unit combined with a developer unit.

Referring to FIG. 1, illustrated are a photosensitive unit 20 and a developer unit 10 in an image forming apparatus. A photosensitive drum 22 is located in the photosensitive unit 20 in a way such that a development section of the photosensitive drum 22 is located opposite to a developing roller 14 of the developer unit 10. In the developer unit 10 that is located side by side with the photosensitive unit 20, a toner contained in a toner container 11 is agitated by an agitator 12 as it is fed toward a feed roller 13. After passing by the feed roller 13, the toner is negatively charged between the feed roller 13 and the developing roller 14, both of which rotate in the direction of the arrow X, and at the same time the toner is adhered to the developing roller 14 in a thin layer. Once the toner is adhered to the surface of the developing roller 14, it is formed as an even, thin layer by means of a blade member 15, then exposed at a position where the photosensitive drum 22 is located at the opposite side, and adhered to an electrostatic latent image at a position where the toner touches the photosensitive drum 22, which rotates in the direction of the arrow X'.

The photosensitive unit 20, which is located side by side with the developer unit 10, includes the photosensitive drum 22 used as a photosensitive body, which is rotated at a predetermined rate driven by a driving mechanism (not shown) mounted on a frame 21, and a transfer roller 26, which is used to transfer the toner image formed on the photosensitive drum 22 onto recording sheets. Further, around the photosensitive drum 22 are positioned the transfer roller 26, a memory removing member 23, a charging roller 24, and an exposing unit 25 in the rotational order of the photosensitive drum 22. After the photosensitive drum 22 is uniformly charged by the charging roller 24, an electrostatic latent image is formed on the surface of the photosensitive drum 22 with a light beam emitted from the exposing unit 25. On the electrostatic latent image is placed the toner from the developing roller 14 to create a toner image, which will be transferred to a recording sheet being fed to the image transfer section by applying a predetermined transfer voltage from the back of the recording sheet by means of the transfer roller 26.

The residual toner on the photosensitive drum 22, after the toner image has been transferred to the recording sheet in said image transfer section, is stirred by a roller-type memory erasing means 23, which may take the form of a brush or a sponge, so that the adhesion strength to the photosensitive drum can be reduced. Then the rotating charging roller 24, which is like a brush in shape, further apply stirring effect, and at the same time uniformly charges the whole surface of the photosensitive drum to make it ready for the next exposure. The image forming apparatus described and illustrated here is what is called a cleaner-less apparatus, in which cleaning means are not used to remove the residual toner and other things on the photosensitive drum after the toner image is transferred on a recording sheet. Instead, after the memory erasing member 23 and the charging member 24 reduce adhesive strength of the toner, the toner is recollected by the developing roller 14 into the developer unit 10 to be re-used mixed with newly supplied toner.

Figure 2:
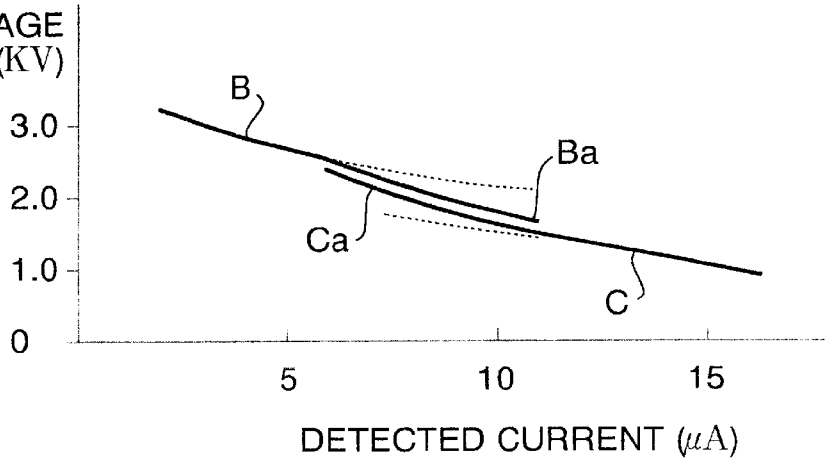
FIG. 2 is a graph showing the temperature characteristic of the voltage applied to the transfer roller.

In the transfer roller 26, the transfer bias is controlled based on the relationship between the applied voltage (kV) and the detected current ($\mu$A) as shown in the graph of FIG. 2, indicated in the vertical axis and in the horizontal axis respectively. For example, in the graph, when the temperature is below 20° C., the voltage to be applied is controlled in accordance with the curve B. When the temperature is 20° C. or above, the voltage to be applied is controlled in accordance with the curve C. In order to avoid drastic change in voltage if the temperature change encompasses 20° C. (in the area where the curve B and curve C coexist), the curves have been changed to Ba and Ca to control the voltage application. It should be noted that the curves Ba and Ca are actually overlapped completely, but the two curves are described separately for the convenience of explanation.

There is a gap between each two recording sheets that are fed in succession, so that the photosensitive drum 22 touches the transfer roller 26 directly at the gap between the recording sheets. As a result, the toner adhered to the photosensitive drum 22 is transferred to the transfer roller 26, causing contamination. In addition, paper particles and other particles floating inside the apparatus aria adhered to the transfer roller 26, tainting the back of the recording sheets, further causing uneven distribution of the voltage applied from the back of the recording sheets. This will result in uneven transfer of the toner image to the recording sheet from the photosensitive drum. Therefore, in the image forming apparatus, a cleaning sequence is employed for the transfer roller 26, whereby the toner, negatively charged, attaching to the transfer roller 26 as well as paper particles and others can be transferred back to the photosensitive drum 22 whenever a predetermined number of recorded sheets are made, and every time the recording (printing) onto a recording sheet is started.

Figure 3:
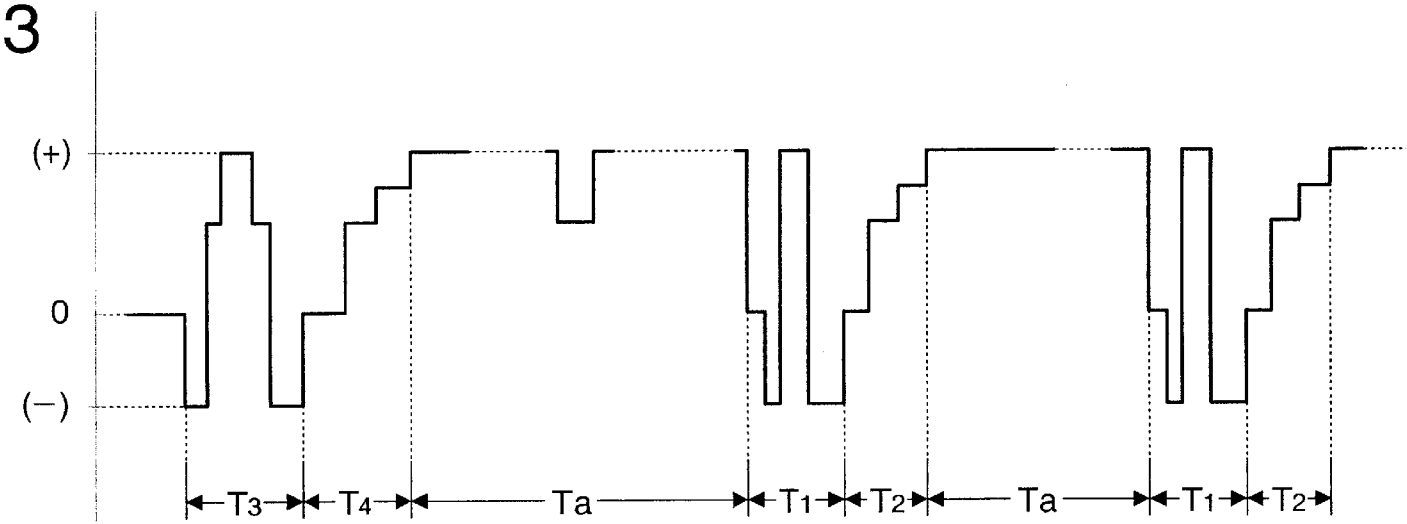
FIG. 3 is a time chart showing how the voltages to be applied to the transfer roller are changed during the FB sequence.

The control of the voltage applied to the transfer roller 26 is performed in a way shown in the time chart of FIG. 3. After the main switch of the image forming apparatus is turned on, test voltage application is performed against the transfer roller for a predetermined duration of T3. At the same time, the initializing operation is performed to the elements and functions of the apparatus. The voltage is within the range between the cleaning voltage (negative) and the transfer voltage (positive). Based on the detected current value, the initial amount of voltage to be applied to the transfer roller is decided. After increasing the voltage in several increments in the period T4, the operations of the image forming mechanism and paper feed mechanism are started, and then the operation of transferring the toner image from the photosensitive drum 22 to the recording sheets to produce a predetermined number of recorded sheets begins. The recording on the recording sheets is performed based on the set number displayed on the control panel of the image forming apparatus. FB sequence is also programmed to be performed after a certain number of recording sheets are recorded.

In the time chart, the duration of successively feeding a predetermined number of recording sheets is indicated by Ta, and the duration of the FB sequence is indicated by T1. While the recording sheets are touching the contact roller, the transfer voltage (positive) is maintained at the same level, though the voltage is reduced to a level of pre-transfer voltage at a position of a gap between the two recording sheets successively fed through the recording sheet passage. After the duration of Ta, the operations of feeding recording sheets and the forming of toner image on the photosensitive drum are stopped, and the FB sequence for the transfer roller is performed.

During the time T1 when said FB sequence is performed and the time T2 when the voltage to be applied is increased from the cleaning voltage to the transfer voltage in several increments, the operation of recording on recording sheets is stopped. The timing of beginning the FB sequence is programmed in advance in the operation program in the main control unit of the image forming apparatus. After a certain number of recorded sheets are made (Ta), the FB is performed. The currents detected when the test voltage is applied will determine the next voltage to be applied. Each time the FB sequence is completed, the value of voltage to be applied is adjusted.

The advantage of performing the FB sequences is that the voltage to be applied for the transfer roller can be changed in accordance with the curves B, C (of the control factors) shown in FIG. 2. In FIG. 3, the horizontal axis indicates time and the vertical axis indicates voltage to be applied. While the cleaning voltage (negative) is fixed at −900 V, the transfer voltage (positive) is determined in accordance with the current-voltage relationship shown in FIG. 2 based on the detected currents. As is shown in FIG. 3, when the FB sequence is performed, the voltage of −900 V is once applied to the transfer roller, and then the transfer voltage (positive) is applied for a predetermined duration. Subsequently, the voltage is increased from 0 V to the transfer voltage (positive) in the stepwise manner. During the time a predetermined number of recorded sheets are made, the transfer voltage is generally maintained. When the number of copy reaches the predetermined number (if indicated in terms of time, after the duration of Ta), another FB sequence begins, and the next value for the voltage to be applied to the transfer roller is decided. Therefore, in an example shown in FIG. 3, as the number of recorded sheets increases, the detected current changes. As a result, the transfer voltage applied to the transfer roller can be reduced accordingly.

Figure 4:
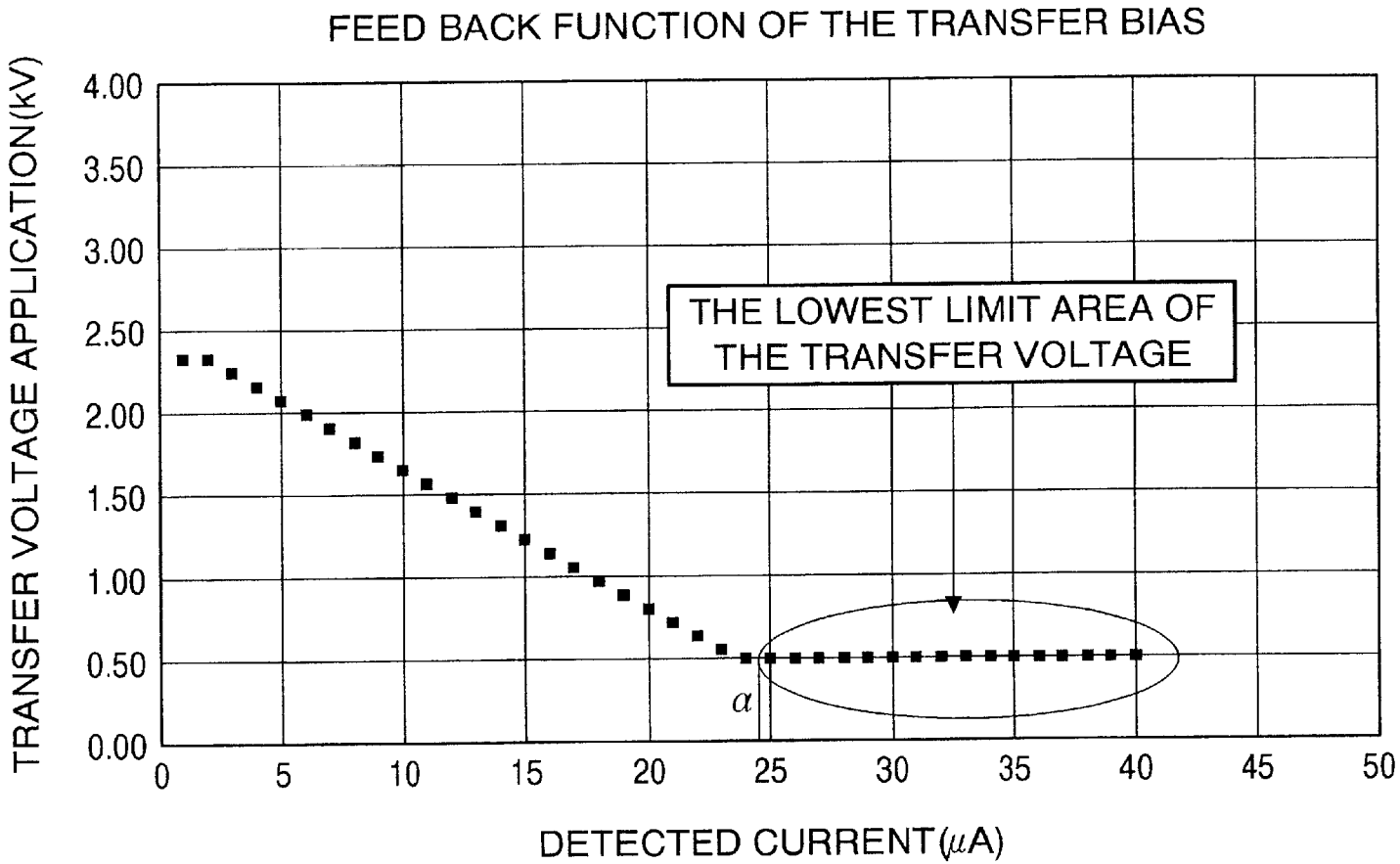
FIG. 4 is a graph showing the relationship between the voltages applied to the transfer roller and the detected currents.

As for the relationship between the applied transfer voltage and the detected currents, the graph of FIG. 4 shows the data obtained in one type of image forming apparatus. In a case where a large number of recorded sheets are made in one job, not only the temperature inside the apparatus increases, but also the environment of the area surrounding the photosensitive drum changes. As is shown by the curves B, Ba (Ca), C in FIG. 2, the value of the voltage to be applied compared to the detected current decreases. In an example described above where a large amount of recorded sheets are made in one job and the FB sequence is repeated at the predetermined intervals, when the currents are measured at the transfer roller, the currents detected along with the changing environment decreases gradually.

The bias voltage to be applied after the FB sequence is decided based on the detected current and the value of voltage to be applied determined from in FIG. 4. When the value of voltage to be applied reaches $\alpha$, for example, +500V, programming +500V is enough for appropriate transfer of the toner image from the photosensitive drum to the recording sheet. In the embodiment herein described, this stage where the transfer bias voltage becomes $\alpha$ is called the saturation. Once the saturation has been reached, even if the FB sequence is performed thereafter, the value of the bias voltage is not changed. In other words, this value is the lowest. Therefore, once the voltage has reached the lowest bias voltage, there will be no need to perform FB sequences. So, for example, once the detected current reaches 25 $\mu$A, FB sequence can be omitted, and successive recording operation without interruption is made possible.

As shown in FIGS. 3 and 4, in order to program the next transfer bias voltage based on the detected current obtained when a test voltage is applied to the transfer roller, a transfer voltage control unit 30 is connected for the transfer roller 26 as is shown in FIG. 1 to apply the programmed value of voltage to the axis of the transfer roller 26. The transfer voltage control unit 30 includes a voltage application circuit 32 that applies voltage to the transfer roller under control of a control circuit 31, a memory 33 that stores the current-voltage relationships as shown in FIGS. 2 and 4 for the control circuit 31, and a control table 34 that is used for changing the control conditions based on the detected current. In addition, a sensor circuit 36 which detects a current obtained from the transfer roller when test voltages are applied in FB sequences is connected to the control circuit 31. Based on the information from the current detecting circuit 36, the voltage applied to the transfer roller after a FB sequence is programmed. Further, another sensor 35 is installed to measure the temperature at a certain position inside the image forming apparatus. The temperature information detected by the sensor 35 is input into the control circuit 31 so that transfer voltages can be adjusted whenever necessary in accordance with the temperatures within the apparatus.

When it is determined that a certain number of copied sheets are made based on the conditions set in the main control unit of the image forming apparatus, the transfer voltage control unit 30 performs the FB sequence. During the FB sequence, the paper feed is stopped, and voltage application to the voltage application units for the photosensitive drum 22 including the charging roller 24 and the developing roller 14 is suspended. Subsequently, −900 v is applied to the transfer roller and then a test voltage (positive) is applied so that the current can be detected. After the test voltage is applied, the voltage is returned to 0 V, and then the voltage is increased to the level decided based on the detected current in several increments so that the electrical shock to the photosensitive drum will be alleviated.

Figure 5:
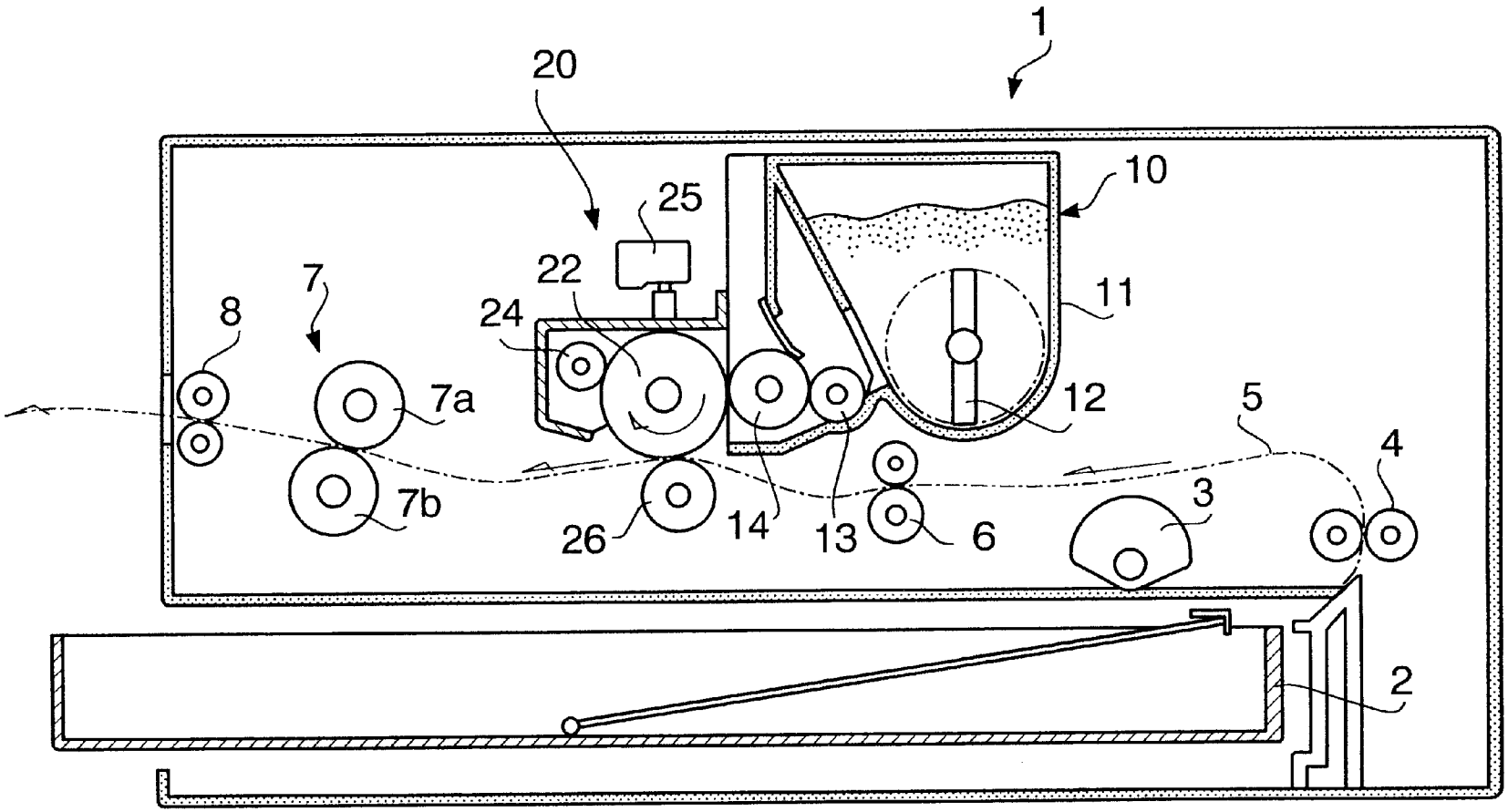
FIG. 5 illustrates a schematic view of an image forming apparatus utilizing the photosensitive unit shown in FIG. 1.

The arrangement for and method of changing the voltage applied to the transfer roller 26 described above may be incorporated in an image forming apparatus 1 shown in FIG. 5. The image forming apparatus 1 can be combined with an image scanning apparatus to create an electro-photographic copy machine, or with a personal computer interface to create a printer, or with an image scanning apparatus as well as a facsimile module to create a facsimile machine, or a multi-purpose machine where several functions are combined.

In the image forming apparatus 1, a pick-up roller 3 located in the feed section of a feed tray 2 sends recording sheets one by one. Paper feed roller mechanisms 4 and 6 send the recording sheets through a paper feed passage 5. While the recording sheet goes between a photosensitive drum 22 and a transfer roller 26, a toner image formed on the photosensitive drum 22 is transferred. The recording sheet on which the toner image is transferred, goes on between a heat roller 7*a* and a nip roller 7*b* of a fixing unit 7 to be fixed and then discharged to a unloading tray (not shown) by means of a discharging roller 8. In the illustrated image forming apparatus 1, the information supplied to an exposure member 25 may be supplied from an image scanner (not shown) which is used in combination with the image forming apparatus 1, or from digital signals received on a facsimile machine. The formation of image on the photosensitive body is done through light emitted from LED elements of the exposure member 25. It should be noted that similar reference numerals are used in FIGS. 1 and 5 to designate similar elements.

What is claimed is:

1. An image forming apparatus comprising:

a first control unit for executing a sequence of adjusting a transfer bias every time a predetermined condition is met; and a second control unit for stopping said sequence when it determines that the transfer bias has reached a saturation.

2. The image forming apparatus as recited in claim 1, wherein the second control unit determines that the transfer bias has reached the saturation when a current running in the transfer roller exceeds a predetermined value.

3. The image forming apparatus as recited in claim 2, wherein the predetermined value is about 25 $\mu$A.

4. The image forming apparatus as recited in claim 1 further including a temperature sensor for measuring temperatures, based on which as well as on a current running in the transfer roller, the first control unit adjusts the transfer bias.

5. The image forming apparatus as recited in claim 3, wherein the temperature sensor measures at least one of temperatures inside and outside the image forming apparatus.

6. The image forming apparatus as recited in claim 1, wherein the second controller determines that the transfer bias has reached the saturation when the transfer bias becomes a predetermined voltage.

7. The image forming apparatus as recited in claim 6, wherein the predetermined voltage is about 500V.

8. An image forming apparatus comprising:

a photosensitive body;

a charging member for charging the photosensitive body;

an exposing unit for forming an electrostatic latent image on the charged photosensitive body;

a developer unit for causing a toner to adhere onto the electrostatic image to develop the electrostatic latent image into a toner image;

a transfer member that touches, through a recording sheet, the photosensitive body for transferring the toner image from the photosensitive body onto the recording sheet;

a memory removing member for agitating a residual toner that remains on the photosensitive body without being transferred;

a paper feed mechanism for feeding recording sheets between the photosensitive body and the transfer member;

a voltage application circuit for applying a test voltage and a transfer bias to the transfer member;

a current detecting circuit for detecting a current running in the transfer member when the test voltage is applied to the transfer member; and a control unit for executing a sequence applying the test voltage to the transfer member when there is no recording sheet between the photosensitive body and the transfer member, and determining the transfer bias in accordance with the current detected in the current detecting circuit, the control unit further stopping said sequence when it is judged that the transfer bias has reached a saturation.

9. The image forming apparatus as recited in claim 8, wherein the control unit determines that the transfer bias has reached the saturation when the current detected in the current detecting circuit exceeds a predetermined value.

10. The image forming apparatus as recited in claim 9, wherein the predetermined value is about 25 $\mu$A.

11. The image forming apparatus as recited in claim 8 further including a temperature sensor for detecting temperatures, and wherein the control unit adjusts the transfer bias based on the temperature detected by the temperature sensor and on the current detected in the current detecting circuit.

12. The image forming apparatus as recited in claim 11, wherein the temperature sensor detects at least one of temperatures inside and outside the image forming apparatus.

13. The image forming method as recited in claim 8, wherein it is determined that the transfer bias has reached the saturation when the transfer bias becomes a predetermined voltage.

14. The image forming method as recited in claim 13, wherein the predetermined voltage is about 500V.

15. An image forming method comprising the steps of:

(A) applying a test voltage when there is no recording sheet between a photosensitive body and a transfer member, and the photosensitive body and transfer member touch with each other directly;

(B) determining whether a transfer bias has reached a saturation;

(C) no longer performing the step (A) when the transfer bias has reached the saturation whereas deciding the transfer bias in accordance with the value of the current when the transfer bias has not reached the saturation; and (D) performing the step (A) after a predetermined number of recording sheets have had the image transferred if the transfer bias is decided in the step (C).

16. The image forming method as recited in claim 15, wherein it is determined that the transfer bias has reached the saturation when the current detected in step (B) has exceeded a predetermined value.

17. The image forming method as recited in claim 16, wherein the predetermined value is about 25 $\mu$A.

18. The image forming method as recited in claim 15, wherein the transfer bias is decided based on the temperature as well as the current in the step (C).

19. The image forming method as recited in claim 15, wherein it is determined that the transfer bias has reached the saturation when the transfer bias becomes a predetermined voltage.

20. The image forming method as recited in claim 19, wherein the predetermined voltage is about 500 V.

* * * * *